US007048365B2

(12) United States Patent
Hilton et al.

(10) Patent No.: US 7,048,365 B2
(45) Date of Patent: May 23, 2006

(54) PRESSURE CONTROL ARCHITECTURE FOR FLUID TANKS HAVING FLUID LEVEL SENSING

(75) Inventors: Brian S. Hilton, Penfield, NY (US); Eric A. Merz, Palmyra, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 63 days.

(21) Appl. No.: 10/747,396

(22) Filed: Dec. 30, 2003

(65) Prior Publication Data

US 2005/0140759 A1 Jun. 30, 2005

(51) Int. Cl.
*B41J 2/175* (2006.01)
*B41J 2/195* (2006.01)

(52) U.S. Cl. ..... 347/86; 347/7; 347/85

(58) Field of Classification Search ..... 347/7, 347/86, 87

See application file for complete search history.

(56) References Cited

U.S. PATENT DOCUMENTS 6,520,630 B1 * 2/2003 Oda et al. ..... 347/85
2002/0196317 A1 * 12/2002 Santhanam et al. ..... 347/85

OTHER PUBLICATIONS

U.S. Appl. No. 10/455,357 to Eric A. Merz et al., filed Jun. 6, 2003.

* cited by examiner

*Primary Examiner*—Lamson Nguyen
*Assistant Examiner*—Jannelle M. Lebron

(74) *Attorney, Agent, or Firm*—Oliff & Berridge PLC

(57) ABSTRACT

A refillable fluid container system having a pressure control architecture in which persistent air bubbles are released from a capillary or foam fluid reservoir and are directed from an optical level sensing system in a liquid fluid reservoir.

19 Claims, 8 Drawing Sheets

Ink sensor signal level verses height of bubbles.

PRESSURE CONTROL ARCHITECTURE FOR FLUID TANKS HAVING FLUID LEVEL SENSING

BACKGROUND OF THE INVENTION

1. Field of Invention

This invention relates to fluid tanks.

2. Description of Related Art

Fluid ejector systems, such as drop-on-demand liquid ink printers, have at least one fluid ejector from which droplets of fluid are ejected towards a receiving sheet. Scanning ink jet printers are equipped with fluid ejection heads containing fluid ink. The ink is applied to a sheet in an arrangement based on print data received from a computer, scanner or similar device. To control the delivery of the fluid to the sheet, fluid ejection heads are moved across the sheet to provide the fluid to the sheet, which is ejected as drops. These drops correspond to a liquid volume designated as pixels. Each pixel is related to a quantity needed to darken or cover a particular unit area.

In order to lower cost and improve performance by limiting inertia, moving-head fluid ejection systems are designed with low weight fluid ejection heads that often use refillable fluid containers. In order to minimize weight, the fluid ejection heads contain a relatively small quantity of fluid. Consequently, the fluid ejection heads (or their fluid reservoirs) must either be replaced or refilled periodically. Replaceable cartridges are commonly used in home-use printers. Some heavier-use printers in industry attach the fluid ejection head via an umbilical tube to a larger tank for continuous refilling. Other heavier-use printers refill the fluid ejection head periodically.

This invention is directed to a fluid tank, such as for use in a printing device and which has a foam element inside of a fluid tank chamber which has a fluid tank supply port opening. Variation in the compression of the foam element results in reduced fluid leakage from the fluid tank through the fluid tank supply opening when the supply opening seal is removed, improved fluid usage and efficiency, reduced fluid impedance within the foam element during the process of filling the tank with fluid, reduced fluid leakage at high altitude/reduced atmospheric pressure, reduction of deprime conditions, and improved fluid delivery pressure to the print head to which the fluid tank is connected in operation.

SUMMARY OF THE INVENTION

Replacing cartridges requires frequent interaction by the user, and is considered disadvantageous for fluid ejectors used in volume production or connected by a network to the ejection data source. Umbilical systems can be expensive, requiring pressurization, tubing, tube harness dressing, and can suffer performance degradation from moisture loss, pressure fluctuations due to acceleration or temperature variation, and motion hysterisis from tubing harness drag.

One common fluid ejection system is an ink jet printer. In an ink jet printer, periodic refill systems commonly do not accurately meter the ink that is deposited into the printhead. Consequently, the ink reservoir in a printhead must be significantly underfilled in order to avoid excess ink spilling out of the refilled printhead ink reservoir. Consequently, this under-filling wastes space and reduces the productivity of the printer due to the greater frequency of refill operations.

Similarly, other containers for consumable fluids in various applications of fluid ejection may require sensing fluid level for refill or replacement of the fluid in a fluid reservoir.

Such applications include, but are not limited to dispensing medication, pharmaceuticals, photo results and the like onto a receiving medium, injecting reducing agents into engine exhaust to control emissions, draining condensation during refrigeration, etc. Other technologies that use refillable fluid containers include fuel cells, fuel tanks, chemical handling systems and electric batteries. Fluid level sensing in fluid container in these technologies is difficult because electrical fluid sensing may introduce hazards, e.g., spark ignition into the fluid contained in the fluid container, or in which the fluid may deteriorate the electrical sensors, e.g., from corrosion.

One optical level sensing system for a fluid reservoir includes one or more sensor targets, such as optical prisms, to reflect light from an emitter to a photosensor. The sensor system determines whether the fluid level descends below one or more of the sensor targets. The sensor targets may include a low prism or sensor target at a low liquid level in the fluid reservoir, and a high prism or sensor target at a high liquid level in the fluid reservoir. The emitter projects the light ray through at least one of the low prism or sensor target to the low incident surface and the high prism or sensor target to the high incident surface. The photosensor senses the light ray reflected from the low prism or sensor target when the liquid is below the low prism or sensor target. The photosensor also senses the light ray from the high prism or sensor target when the liquid level is below the high prism or sensor target. More particularly, the sensor uses the absence of the light ray to detect when the fluid level rises above the high incident surface of the high prism or sensor target.

In fluid tanks, such as, for example, an ink tank for use in a printing device, a capillary or foam element inside of a fluid reservoir chamber can be used as at least a portion of the fluid reservoir. In such fluid tanks, the fluid reservoir chamber includes a liquid fluid reservoir and a capillary medium chamber, having a capillary or foam element therein. The liquid fluid reservoir and a capillary medium chamber are separated by a barrier, which has a barrier gap or orifice for fluid to pass from the capillary medium chamber into the liquid fluid reservoir. However, in addition to the fluid stored, air may also be present in the capillary medium chamber, and may pass into the liquid fluid reservoir via the barrier gap or orifice.

However, in such an architecture during fluid use, air from the capillary medium chamber will pass into the liquid fluid reservoir and form bubbles. These bubbles can collect on the sensor targets of the fluid level sensing system. As fluid drains from the cartridge, the bubbles of fluid may coat the reflecting surfaces of the or sensor targets. Fluid on these surfaces refracts light, instead of reflecting it, and causes the cartridge to appear falsely full to the photosensor.

This invention is directed to a fluid tank, such as for use in a printing device and which has a foam element inside of a fluid tank chamber which has a fluid tank supply port opening. Variation in the compression of the foam element results in reduced fluid leakage from the fluid tank through the fluid tank supply opening when the supply opening seal is removed, improved fluid usage and efficiency, reduced fluid impedance within the foam element during the process of filling the tank with fluid, reduced fluid leakage at high altitude/reduced atmospheric pressure, reduction of deprime conditions, and improved fluid delivery pressure to the print head to which the fluid tank is connected in operation.

Thus, this invention provides devices and methods for preventing the collection of fluid bubbles in a liquid fluid reservoir containing an optical level sensing system for fluid level detection.

In various exemplary embodiments, a fluid tank architecture is provided including at least one liquid fluid reservoir, at least one capillary medium chamber and an optical level sensing system.

These and other features and advantages of this invention are described in, or are apparent from, the following detailed description of various exemplary embodiments of the systems and methods according to this invention.

DETAILED DESCRIPTION OF PREFERRED EMBODIMENTS

The following detailed description of various exemplary embodiments of the fluid containers having a communication channel between the manifold and ink reservoir, according to this invention may refer to one specific type of fluid system, e.g., an ink jet printer that uses the refillable fluid containers according to this invention, for sake of clarity and familiarity. However, it should be appreciated that the principles of this invention, as outlined and/or discussed below, can be equally applied to any known or later-developed fluid ejection systems, beyond the ink jet printer specifically discussed herein.

Figure 1:
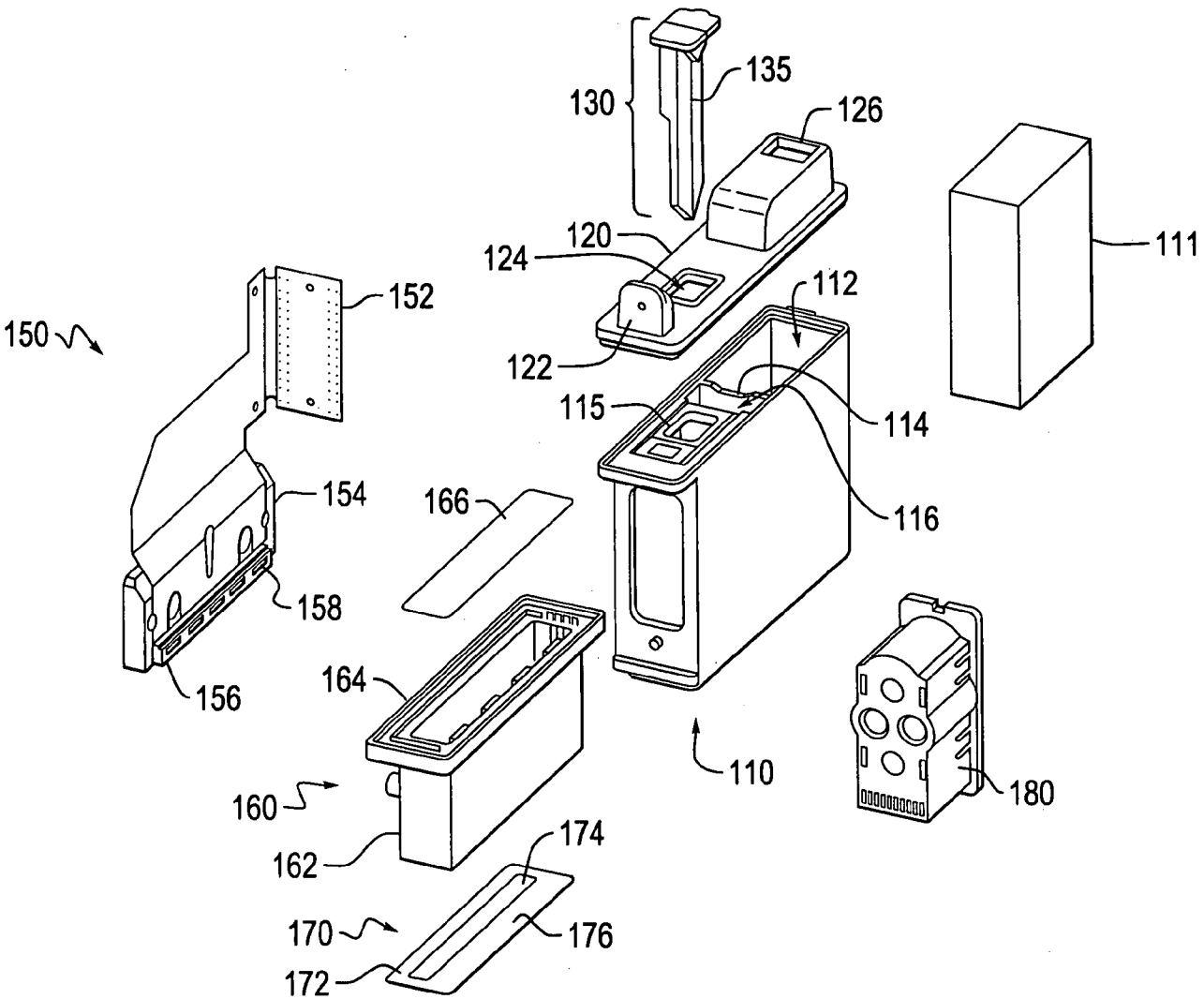
FIG. 1 is an exploded view of a conventional refillable fluid container.

FIG. 1 shows an isometric exploded view of a cartridge reservoir 100 for an inkjet printhead. The cartridge reservoir 100 includes a fluid chamber 110, a chamber lid 120, a fluid ejection interface module 150, a manifold 160, a face tape 170 and a refill port 180. Such conventional refillable fluid containers may optionally include a fluid level sensor 130, such as an optical level sensing system. One such optical level sensing system is described, for example, in U.S. patent application Ser. No. 10/455,357, filed Jun. 6, 2003, which is incorporated by reference herein in its entirety. A capillary medium insert 111 can be inserted into the fluid chamber 110.

The fluid chamber 110 includes a capillary medium chamber 112 and a liquid fluid reservoir 116. The capillary medium insert 111 can be received into the capillary medium chamber 112 through an open top before the chamber lid 120 is disposed on the fluid chamber 110. Above the liquid fluid reservoir 116 is disposed a frame 115 that receives the prism or sensor target 135. A barrier wall 114 separates the capillary medium chamber 112 and the liquid fluid reservoir 116 to enable separate fluid levels in the two divided chambers, but enabling fluid to communicate under the barrier wall 114 along a barrier gap or orifice 118 (shown in FIG. 3). The barrier gap or orifice 118 provides a wetted passage for the fluid between the capillary medium chamber 112 and liquid fluid reservoir 116. The fluid chamber 110 communicates fluid to the manifold 160 through a filter 166 that is disposed within the manifold rim 164. The liquid fluid reservoir 116 is otherwise isolated, while the capillary medium chamber 112 is connected to the ventilation port 122 to enable air to communicate therebetween. Thus, the capillary medium chamber 112 acts as a check valve to the liquid fluid reservoir 116, to enable fluid to pass, while preventing air from entering the liquid fluid reservoir 116 until the fluid level in the capillary medium chamber 112 falls below the level of the barrier gap or orifice 118.

The capillary medium insert 111 can be composed of closed cell reticulated polyurethane. The reticulation (rupture) of the cells can be effectuated by chemical etching or flame treatment to produce a hydroscopic sponge. The capillary medium insert 111 allows the fluid to migrate from a wetted region to a dry region by means of capillary wicking, such as for foam or felt materials. Such capillary media enable negative gauge pressure within the fluid chamber 110. A vent path is connected to the top of the capillary medium insert 111 to allow the fluid to be removed therefrom, and be displaced by air.

The chamber lid 120 includes a ventilation port 122, a sensor target window 124 and a bridge 126. The prism or sensor target 135 can be received into the sensor target window 124 and inserted into the liquid fluid reservoir 116 within the frame 115. The ventilation port 122 includes orifices connecting from outside to inside the cartridge reservoir 100 for equilibrating the capillary medium chamber 112 to ambient pressure.

The interface 150 includes a flexible circuit 152, a heatsink 154 and an ejection chip 156 having intake ports 158. The flexible circuit 152 provides the communication path for signals to eject fluid on command. The heatsink 154 attenuates the temperature response from heating by electrical resistance. Adjoining the heatsink 154 is the ejection chip 156. The intake ports 158 provide passage for fluid to be controllably released by fluid ejection nozzles (not shown) onto a medium (also not shown).

The manifold 160 includes a manifold container 162 and a manifold rim 164. The fluid chamber 110 communicates fluid to the manifold 160 through a filter 166 that is disposed within the manifold rim 164. The bottoms of the heatsink 154, the ejection chip 156 and the manifold container 162 are overlaid by a face tape 170 that provides an interface seal. The face tape 170 includes a heatsink portion 172 covering the bottom of the heatsink 154, an open region 174 to enable the ejection chip 156 to pass fluid out from the fluid ejection nozzles onto the medium, and a manifold portion 176 covering the bottom of the manifold container 162. The fluid passes from the fluid chamber 110 through the filter 166 to the manifold container 162. The fluid is released from the manifold container 162 to the ejection chip 156 through the intake ports 158.

The refill port 180 can be mounted to the fluid chamber 110 along a wall shared by the liquid fluid reservoir 116. The refill port 180 provides an access from which to initially fill the fluid chamber 110 during original manufacture. The refill port 180 also provides the access from which to refill the fluid chamber 110 with fluid after the previously supplied fluid has been expended.

When initially filling the fluid chamber 110 with fluid, the ventilation port 122 is sealed by a gasket, and internal air is evacuated from the fluid chamber 110 to form at least a partial vacuum at a negative gauge pressure (i.e., below ambient pressure). The fluid is transferred through the refill port 180 into the liquid fluid reservoir 116. As the liquid fluid reservoir 116 is filled, some of the fluid passes through barrier gap or orifice 118 in barrier wall 114 into the capillary medium chamber 112. Upon filling the liquid fluid reservoir 116, a small air bubble (resulting from incomplete evacuation) remains in the liquid fluid reservoir 116, with the remainder of the liquid fluid reservoir 116 containing the fluid. Meantime, the capillary medium chamber 112 is about one-half to two-thirds filled with fluid.

During transport and/or initial installation, the ambient pressure and temperature can vary (e.g., decrease in barometric pressure from changes in altitude, or temperature rise during a diurnal cycle or latitude change). Such environments can cause pressure changes in the capillary medium chamber 112 from the conditions during the initial filling operation. The changes in internal pressure in the capillary medium chamber 112 can cause the fluid to expand and migrate through the ventilation port 122. Also, changes in orientation of the cartridge reservoir 100 can cause gravity-induced flow to the upper regions of the capillary medium chamber 112 and into through the ventilation port 122. Fluid escaping through the ventilation port 122 can cause undesired leakage of fluid out of the cartridge reservoir 110. Various exemplary embodiments of this invention are designed to inhibit or prevent such potential leaks.

Additionally, passages in the ventilation port 122 must be clear of obstacles so that air can communicate from ambient conditions to the capillary medium chamber 112. While printing, for example, the fluid is expended through the ejection chip 156 being drawn from the manifold chamber 162. The fluid to the manifold chamber 162 is supplied from the fluid chamber 110, through liquid fluid reservoir 116 and/or the capillary medium chamber 112. As the liquid fluid reservoir 116 is being emptied of the fluid, the capillary medium chamber 112 replenishes the fluid via barrier gap or orifice 118.

During this siphoning, the fluid level of the liquid fluid reservoir 116 rises while the fluid level of the capillary medium chamber 112 drops, and ambient air enters from the ventilation port 122 into the capillary medium chamber 112 to equilibrate the pressure. The fluid levels thereby equilibrate in a manner analogous to a monometer. During operation of a fluid printhead, the fluid chamber 110, which maintains a constant internal volume, must be vented in order to allow the fluid to be removed, and therefore maintain a steady delivery pressure of the fluid to the nozzles. Without ambient air entering the capillary medium chamber 112 to replace the fluid that replenishes the liquid fluid reservoir 116, the fluid would become trapped by the lower pressure in the fluid chamber 110, and propagated to the manifold chamber 162 and to the ejection chip 156. Thus, the ventilation port 122 must enable passage of air without obstruction from the fluid.

Figure 2:
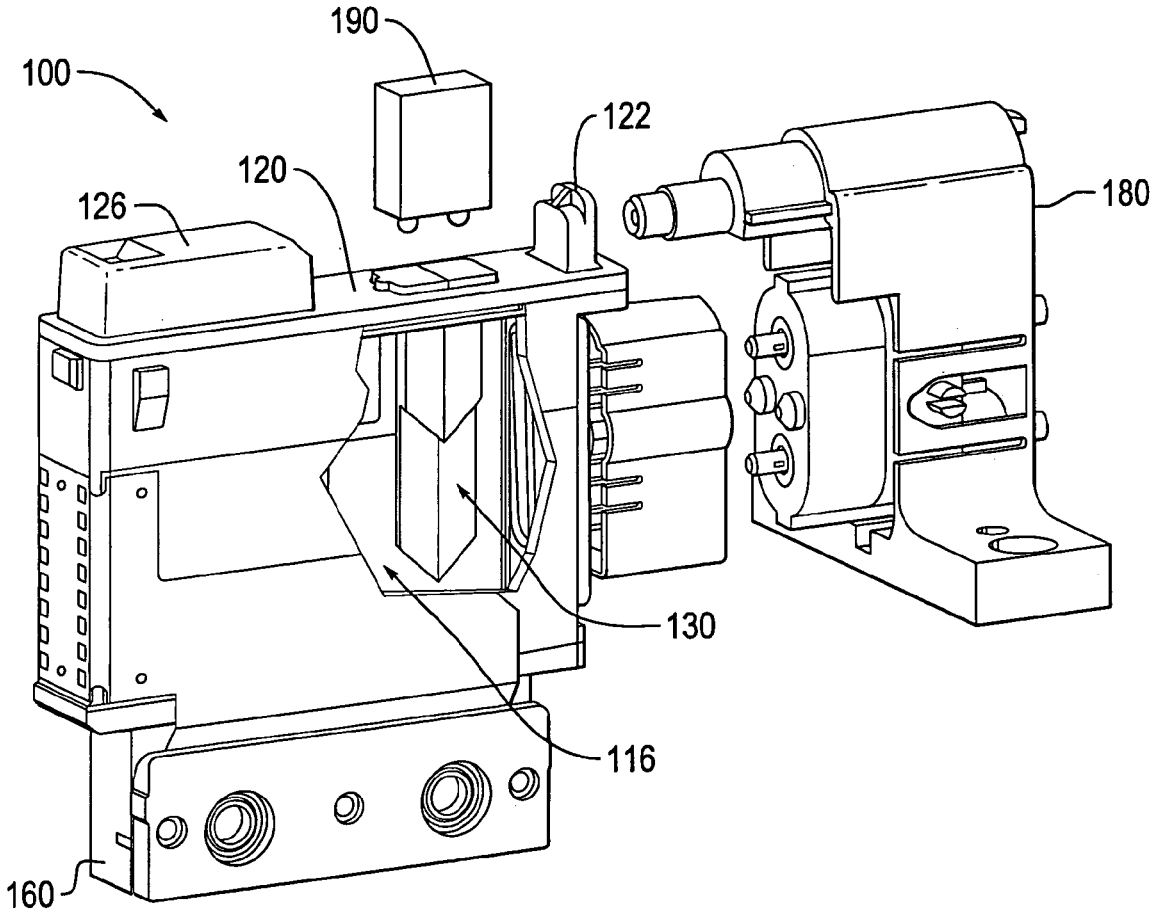
FIG. 2 is an isometric view of a conventional refillable fluid container such as FIG. 1.

FIG. 2 shows an exemplary conventional refillable fluid container 100 such as FIG. 1. The cartridge reservoir 100 includes the fluid chamber 110, the chamber lid 120, the manifold 160 and the refill port 180. The fluid chamber 110 has the capillary medium chamber 112 (not shown), and the liquid fluid reservoir 116 (shown in cut-away). The capillary medium chamber 112 and liquid fluid reservoir 116 are separated from each other by the barrier wall 114 (not shown). The chamber lid 120 includes the ventilation port 122 and the bridge 126.

Inserted in the liquid fluid reservoir 116 is an optional optical level sensing system 130. A sensor 190 provides a light source and receiver for determining a level of fluid within the liquid fluid reservoir 116. A refill station provides instruments to engage the ventilation port 122 and the refill port 180 in order to refill the fluid chamber 110 to appropriate levels.

Figure 3:
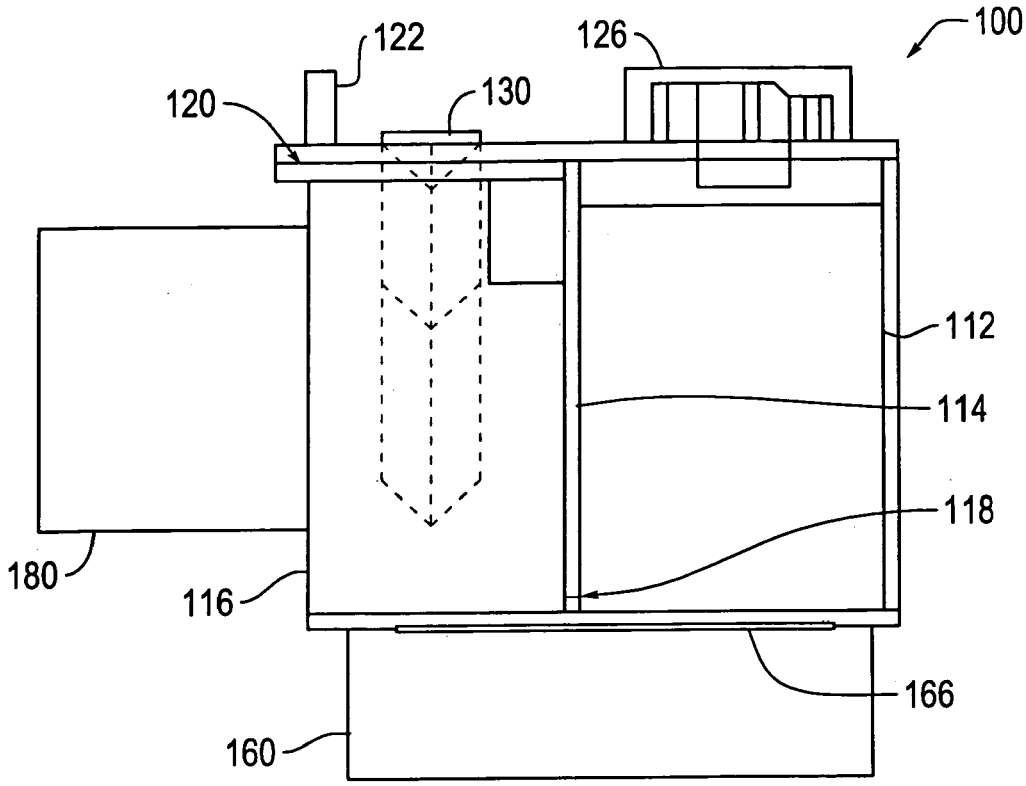
FIG. 3 is an enlarged schematic y-z cross-sectional view of a conventional refillable fluid container such as FIG. 1.

FIG. 3 shows an enlarged schematic y-z cross-sectional view of a conventional refillable fluid container 100. The refillable fluid container 100 consists of a manifold area 160, a liquid fluid reservoir 116 and a capillary medium chamber 112. The liquid fluid reservoir 116 and capillary medium chamber 112 are separated by a barrier wall 114. Communication between the liquid fluid reservoir 116 and capillary medium chamber 112 is enabled by barrier gap or orifice 118 in barrier wall 114. The liquid fluid reservoir 116 and manifold area 160 are separated by a filter means 166. Such conventional refillable fluid containers may optionally include a fluid level sensor 130, such as an optical level sensing system.

Figure 4:
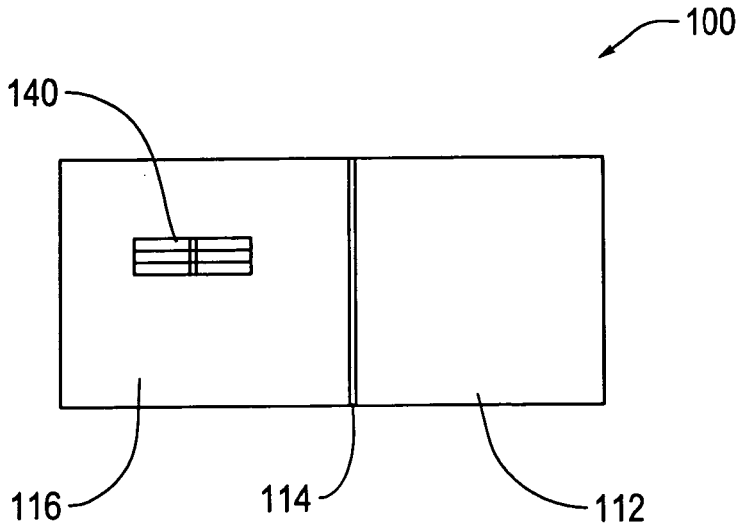
FIG. 4 is an enlarged schematic y-z cross-sectional view of a conventional refillable fluid container such as FIG. 1.

FIG. 4 shows an enlarged schematic y-z cross-sectional view of a conventional refillable fluid container 100. The refillable fluid container 100 includes a liquid fluid reservoir 116 and a capillary medium chamber 112. The liquid fluid reservoir 116 and capillary medium chamber 112 are separated by a barrier wall 114.

Figure 5:
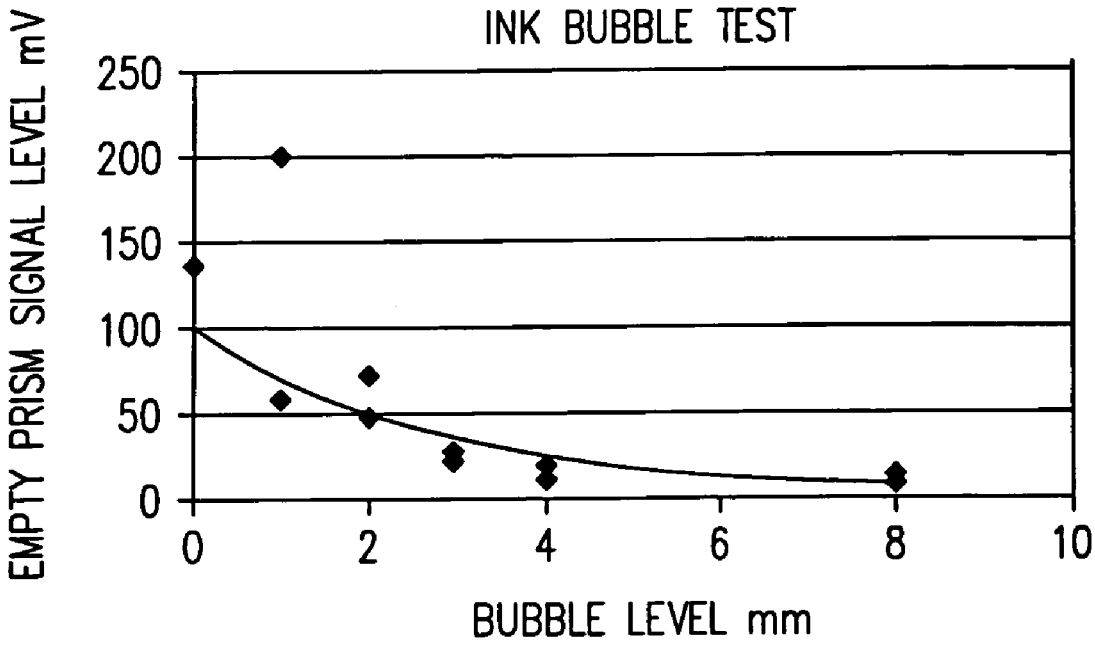
FIG. 5 is a graph comparing the bubble level and the sensor signal levels.

As fluid and air flow from the capillary medium chamber 112 into the liquid fluid reservoir 116, the air forms small bubbles, which are persistent, having a half-life of approximately 20–30 seconds. A "half-life," as used herein, is the time it takes for approximately half of the bubbles to break. Level sensor means, such as optical sensors, are highly sensitive to such bubbles. As bubbles move and break in the liquid fluid reservoir, sensor readings can fluctuate dramatically. As bubbles break and more of the sensors are exposed to air, the overall sensor signal becomes dramatically improved, as shown in FIG. 5.

Figure 6:
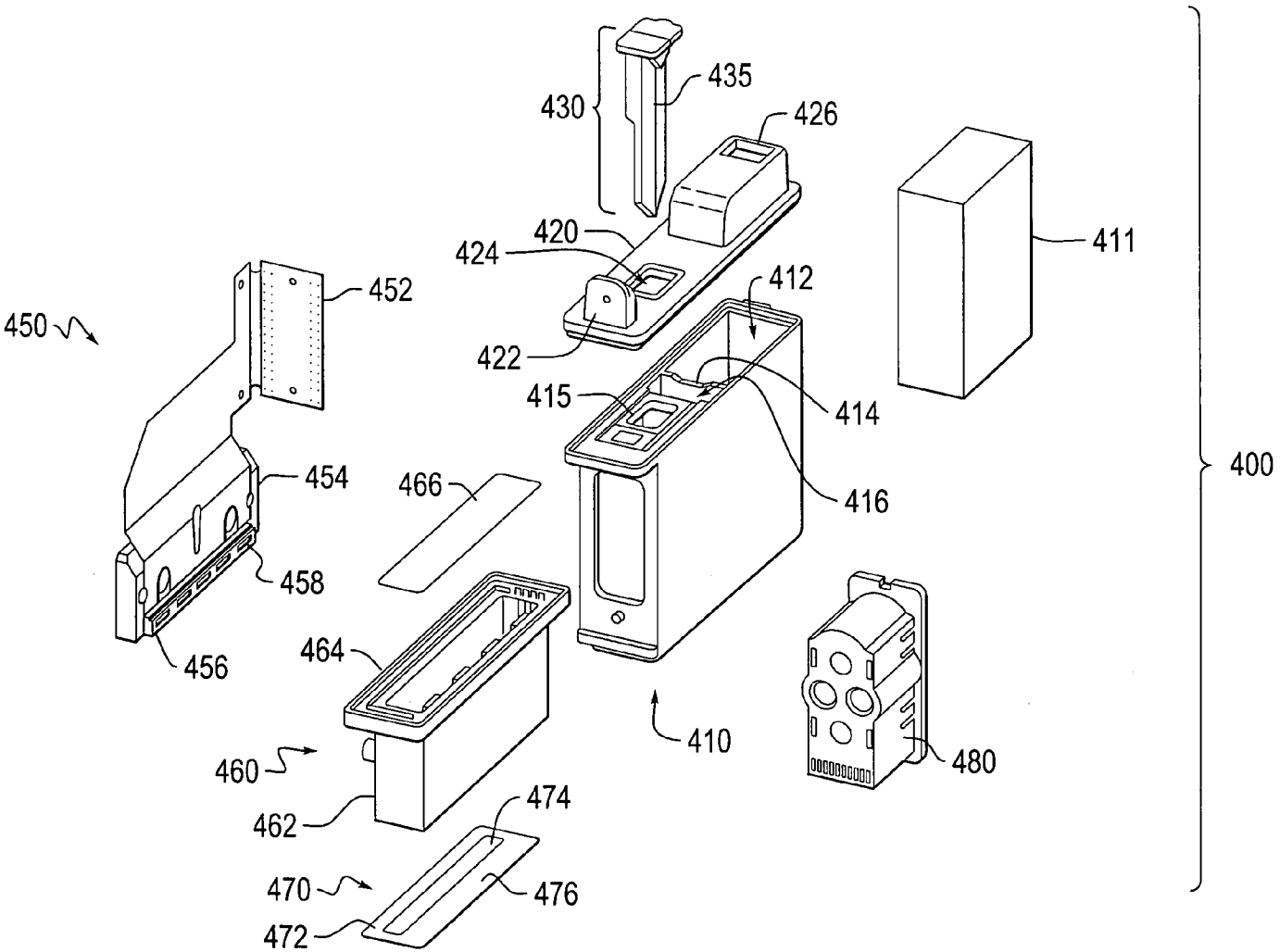
FIG. 6 is an exploded view of a refillable fluid container according to an exemplary embodiment of this invention.

FIG. 6 shows an isometric exploded view of a cartridge reservoir 400 for an inkjet printhead according to this invention. The cartridge reservoir 400 includes a fluid chamber 410, a chamber lid 420, a fluid ejection interface module 450, a manifold 460, a face tape 470 and a refill port 480. Such refillable fluid containers include a fluid level sensor 430, such as an optical level sensing system. A capillary medium insert 411 can be inserted into the fluid chamber 410.

The fluid chamber 410 includes a capillary medium chamber 412 and a liquid fluid reservoir 416, and at least one additional liquid fluid reservoir 417 (shown in FIGS. 8–12). The capillary medium insert 411 can be received into the capillary medium chamber 412 through an open top before the chamber lid 420 is disposed on the fluid chamber 410.

Above the liquid fluid reservoir 416 is disposed a frame 415 that receives the prism or sensor target 435 of the optical level sensing system 430.

A barrier wall 414 separates the capillary medium chamber 412, the liquid fluid reservoir 416 and the at least one liquid fluid reservoir 417 to enable separate fluid levels in the divided chambers, but enabling fluid to communicate through the barrier wall 414 along a barrier gap or orifice 418 (shown in FIGS. 7–11). The barrier gap or orifice 418 provides a wetted passage for the fluid between the capillary medium chamber 412 and the at least one liquid fluid reservoir 417. The location of the barrier gap or orifice 418 is not particularly limited. In various exemplary embodiments, the barrier gap or orifice 418 is located at or near the bottom of the barrier wall 414. The liquid fluid reservoir 416 is able to communicate with the at least one additional liquid fluid reservoir 417 via at least one narrow fluid communication channel 550. The fluid chamber 410 communicates fluid to the manifold 460 through a filter 466 that is disposed within the manifold rim 464. The liquid fluid reservoirs 416 and 417 are otherwise isolated, while the capillary medium chamber 412 is connected to the ventilation port 422 to enable air to communicate therebetween. Thus, the capillary medium chamber 412 may act as a check valve to the liquid fluid reservoir 416, to enable fluid to pass, while preventing air to enter the liquid fluid reservoirs 416 and 417 until the fluid level in the capillary medium chamber 412 falls beneath the level of the barrier gap or orifice 418. The liquid fluid reservoir 416 is able to communicate with the at least one additional liquid fluid reservoir 417 via at least one narrow fluid communication channel 550 (shown in FIGS. 9–12).

The capillary medium insert 411 can be composed of closed cell reticulated polyurethane. The capillary medium insert 411 allows the fluid to migrate from a wetted region to a dry region by means of capillary wicking, such as for foam or felt materials. Such capillary media enable negative gauge pressure within the fluid chamber 410. A vent path is connected to the top of the capillary medium insert 440 to allow the fluid to be removed therefrom, and be displaced by air.

The chamber lid 420 includes a ventilation port 422, a prism or sensor target window 424 and a bridge 426. The prism or sensor target 440 can be received into the prism window 424 and inserted into the liquid fluid reservoir 416 within the frame 415. The ventilation port 422 includes orifices connecting from outside to inside the cartridge reservoir 400 for equilibrating the capillary medium chamber 412 to ambient pressure.

The interface 450 includes a flexible circuit 452, a heatsink 454 and an ejection chip 456 having intake ports 458. The flexible circuit 452 provides the communication path for signals to eject fluid on command. The heatsink 454 attenuates the temperature response from heating by electrical resistance. Adjoining the heatsink 454 is the ejection chip 456. The intake ports 458 provide passage for fluid to be controllably released by fluid ejection nozzles (not shown) onto a medium (also not shown).

The manifold 460 includes a manifold container 462 and a manifold rim 464. The fluid chamber 410 communicates fluid to the manifold 460 through a filter 466 that is disposed within the manifold rim 464. The bottoms of the heatsink 454, the ejection chip 456 and the manifold container 462 are overlaid by a face tape 470 that provides an interface seal. The face tape 470 includes a heatsink portion 472 covering the bottom of the heatsink 454, an open region 474 to enable the ejection chip 456 to pass fluid out from the fluid ejection nozzles onto the medium, and a manifold portion 476 covering the bottom of the manifold container 462. The fluid passes from the fluid chamber 410 through the filter 466 to the manifold container 462. The fluid is released from the manifold container 462 to the ejection chip 456 through the intake ports 458.

The refill port 480 can be mounted to the fluid chamber 410 along a wall shared by the liquid fluid reservoir 416. The refill port 480 provides an access from which to initially fill the fluid chamber 410 during original manufacture. The refill port 480 also provides the access from which to refill the fluid chamber 410 with fluid after the previously supplied fluid has been expended.

When initially filling the fluid chamber 410 with fluid, the ventilation port 422 is sealed by a gasket, and internal air is evacuated from the fluid chamber 410 to form at least a partial vacuum at a negative gauge pressure (i.e., below ambient pressure). The fluid is transferred through the refill port 480 into the liquid fluid reservoirs 416 and 417. As the liquid fluid reservoirs 416 and 417 are filled, some of the fluid passes through barrier gap or orifice 418 in barrier wall 414 into the capillary medium chamber 412. Upon filling the liquid fluid reservoirs 416 and 417, a small air bubble (resulting from incomplete evacuation) remains in the accumulation areas 525 of the liquid fluid reservoirs 416 and 417, with the remainder of the liquid fluid reservoirs 416 and 417 containing the fluid. Meantime, the capillary medium chamber 412 is about half to two-thirds filled with fluid.

During transport and/or initial installation, the ambient pressure and temperature can vary (e.g., decrease in barometric pressure from changes in altitude, or temperature rise during a diurnal cycle or latitude change). Such environments can cause pressure changes in the capillary medium chamber 412 from the conditions during the initial filling operation. The changes in internal pressure in the capillary medium chamber 412 can cause the fluid to expand and migrate through the ventilation port 422. Also, changes in orientation of the cartridge reservoir 400 can cause gravity-induced flow to the upper regions of the capillary medium chamber 412 and into through the ventilation port 422. Fluid escaping through the ventilation port 422 can cause undesired leakage of fluid out of the cartridge reservoir 410. Various exemplary embodiments of this invention are designed to inhibit or prevent such potential leaks.

Additionally, passages in the ventilation port 422 must be clear of obstacles so that air can communicate from ambient conditions to the capillary medium chamber 412. While printing, for example, the fluid is expended through the ejection chip 456 being drawn from the manifold chamber 462. The fluid to the manifold chamber 462 is supplied from the fluid chamber 410, through liquid fluid reservoirs 416 and 417 and/or the capillary medium chamber 412. As the liquid fluid reservoirs 416 and 417 are being emptied of the fluid, the capillary medium chamber 412 replenishes the fluid via barrier gap or orifice 418.

During this siphoning, the fluid levels of the liquid fluid reservoirs 416 and 417 rise while the fluid level of the capillary medium chamber 412 drops, and ambient air enters from the ventilation port 422 into the capillary medium chamber 412 to equilibrate the pressure. The fluid levels thereby equilibrate in a manner analogous to a monometer. During operation of a fluid printhead, the fluid chamber 410, which maintains a constant internal volume, must be vented in order to allow the fluid to be removed, and therefore maintain a steady delivery pressure of the fluid to the nozzles. Without ambient air entering the capillary medium chamber 412 to replace the fluid that replenishes the liquid fluid reservoirs 416 and 417, the fluid would become trapped by the lower pressure in the fluid chamber 410, and propagate to the manifold chamber 462 and to the ejection chip 456. Thus, the ventilation port 422 must enable passage of air without obstruction from the fluid.

Figure 7:
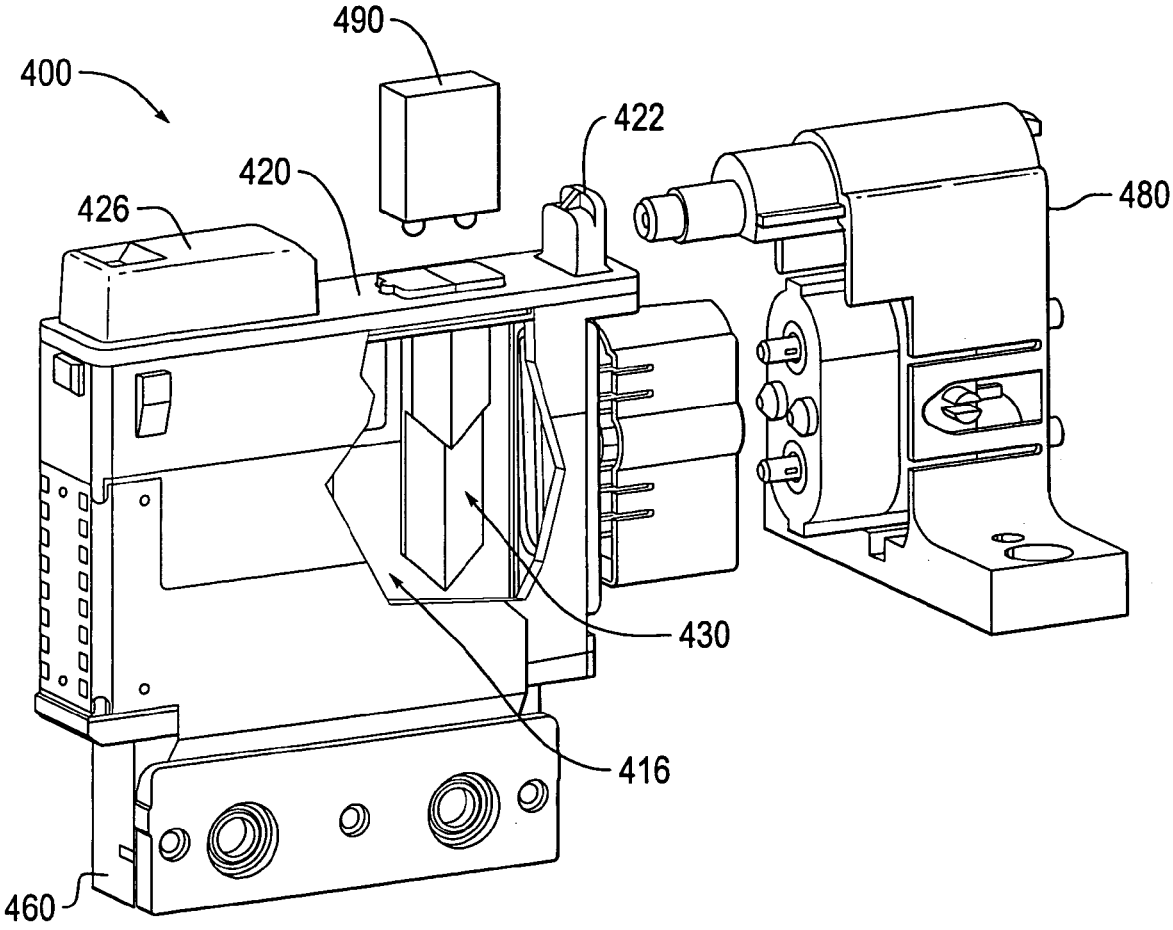
FIG. 7 is an isometric view of a refillable fluid container according to an exemplary embodiment of this invention, such as FIG. 6.

FIG. 7 shows an isometric view of an exemplary embodiment of a refillable fluid container 400 according to the invention, such as FIG. 6. The refillable fluid container 400 includes a fluid chamber 410, a chamber lid 420, a manifold 460 and a refill port 480. The fluid chamber 410 has a capillary medium chamber 412, a liquid fluid reservoir 416 (shown in cut-away) and at least one additional fluid reservoir 417. The capillary medium chamber 412 and the liquid fluid reservoirs 416 and 417 are separated from each other by the barrier wall 414. The chamber lid 420 includes the ventilation port 422 and the bridge 426. Beside the manifold 460 and the fluid chamber 410 are the heatsink 454 and the flexible circuit 452, respectively.

Inserted in the liquid fluid reservoir 416 is the optical level sensing system 440. A sensor 490 provides a light source and receiver for determining a level of fluid within the liquid fluid reservoir 416. A refill station provides instruments to engage the ventilation port 422 and the refill port 480 in order to refill the fluid chamber 410 to appropriate levels.

Figure 8:
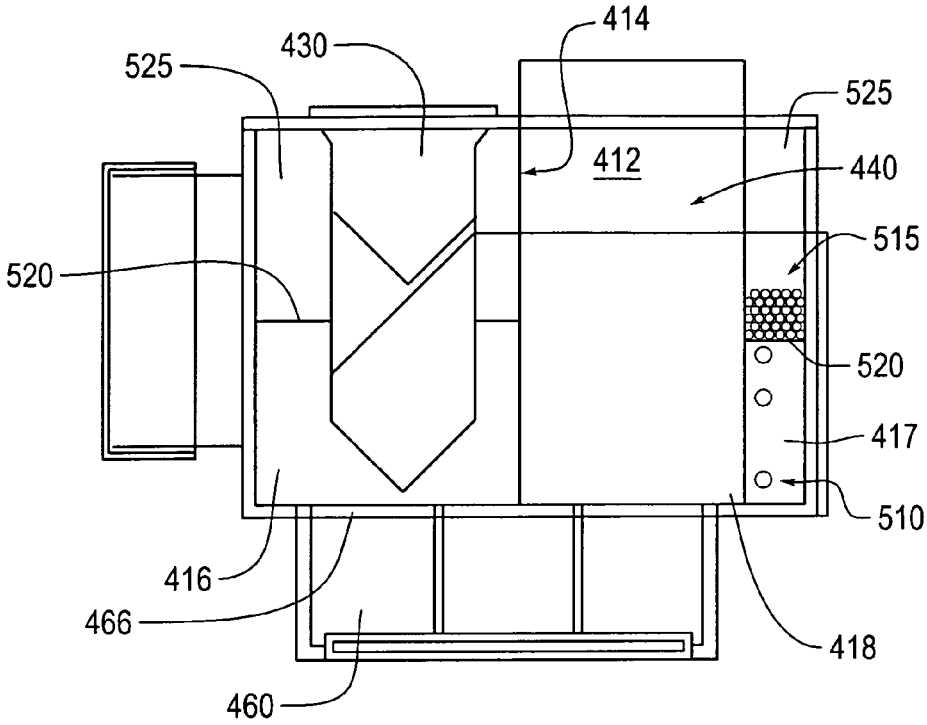
FIG. 8 is an enlarged schematic y-z cross-sectional view of a refillable fluid container according to an exemplary embodiment of this invention, such as FIG. 6.

FIG. 8 shows an enlarged schematic y-z cross-sectional view of an exemplary embodiment of a refillable fluid container 400, according to this invention. The refillable fluid container 400 includes a manifold area 460, a liquid fluid reservoir 416, the at least one additional liquid fluid reservoir 417, a capillary medium chamber 412 and an optical fluid sensing system 430. The liquid fluid reservoirs 416 and 417 are separated from the capillary medium chamber 412 by a barrier wall 414. Communication between the at least one additional liquid fluid reservoir 417 and capillary medium chamber 412 is enabled by at least one barrier gap or orifice 418 in barrier wall 414. Communication between the liquid fluid reservoir 416 and the at least one additional liquid fluid reservoir 417 is enabled by at least one narrow fluid communication channel 550. The liquid fluid reservoirs 416 and 417 include an air accumulation area 525. The liquid fluid reservoir 416 and manifold area 460 are separated by a filter means 466.

The at least one narrow fluid communication channel 550 connects liquid fluid reservoir 416 and at least one additional liquid fluid reservoir 417, and may extend to the top and bottom walls of the fluid chamber of the refillable fluid container 400, and may be bounded by the side walls of the refillable fluid container 400 and/or the barrier wall 414. Thus, the at least one fluid channel 550 may extend the full height of the liquid fluid reservoirs 416 and 417. The optical level sensing device 430 is located in the liquid fluid reservoir 416.

As fluid and air flow from the capillary medium chamber 412 into the at least one additional liquid fluid reservoir 417, the air forms small persistent bubbles 510, having a half-life of approximately 20–30 seconds. The small bubbles 510 rise to the fluid surface in the at least one additional liquid fluid reservoir 417. The surface tension of the small bubbles 510 causes the small bubbles 510 to stick together, forming a froth 515 at the fluid-air interface 520, and are contained in the at least one additional liquid fluid reservoir 417, while the fluid is allowed to flow freely between the at least one additional liquid fluid reservoir 417 and the liquid fluid reservoir 416 through the at least one narrow fluid communication channel 550. The small bubbles 510 in the froth 515 may combine to form larger bubbles, which have a lower surface tension, and readily break. The larger bubbles may pass through the at least one narrow fluid communication channel 550, into the liquid fluid reservoir 416.

Figure 9:
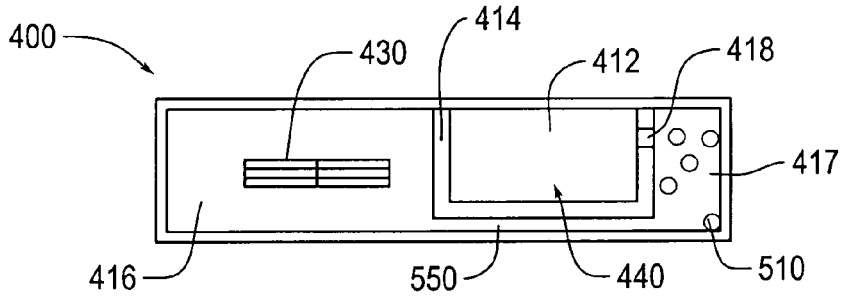
FIG. 9 is an enlarged schematic y-z cross-sectional view of a refillable fluid container an exemplary embodiment of this invention such as FIG. 6.

FIG. 9 shows an enlarged schematic y-z cross-sectional view of an exemplary embodiment of a refillable fluid container 400. The refillable fluid container 400 includes a liquid fluid reservoir 416, at least one additional liquid fluid reservoir 417 and a capillary medium chamber 412. The liquid fluid reservoirs 416 and 417 and capillary medium chamber 412 are separated by at least one barrier wall 414. Communication between at least one of the at least one liquid fluid reservoir 417 and capillary medium chamber 412 is enabled by barrier gap or orifice 418 in barrier wall 414. Free communication of fluid between the at least one additional liquid fluid reservoir 417 and the liquid fluid reservoir 416 is enabled by at least one narrow fluid communication channel 550. The liquid fluid reservoirs 416 and 417 include an air accumulation area 525. The liquid fluid reservoir 416 and manifold area 460 are separated by a filter means 466.

Figure 10:
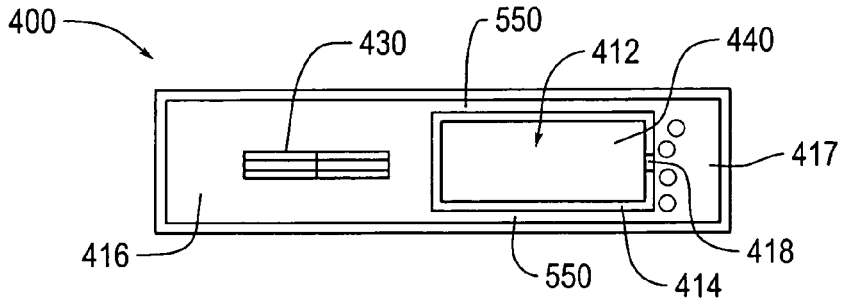
FIG. 10 is an enlarged schematic y-z cross-sectional view of a refillable fluid container an exemplary embodiment of this invention such as FIG. 6.

FIG. 10 shows an enlarged schematic y-z cross-sectional view of an additional exemplary embodiment of a refillable fluid container 400. The refillable fluid container 400 includes a liquid fluid reservoir 416, at least one additional liquid fluid reservoir 417, a capillary medium chamber 412, an optional level sensing system 430 and at least one fluid channel 550. The liquid fluid reservoirs 416 and 417 are separated from capillary medium chamber 416 by a barrier wall 414. Communication between at least one of the additional liquid fluid reservoirs 417 and capillary medium chamber 412 is enabled by barrier gap or orifice 418 in barrier wall 414. The liquid fluid reservoir 416 and at least one additional liquid fluid reservoir 417 are connected by at least two narrow fluid channels 550, which allow the fluid to pass freely between liquid fluid reservoir 416 and the at least one additional liquid fluid reservoir 417. As shown, the two fluid channels 550 are on opposite sides of capillary medium chamber 412. The liquid fluid reservoirs 416 and 417 include an air accumulation area 525. The liquid fluid reservoir 416 and manifold area 460 are separated by a filter means 466.

Figure 11:
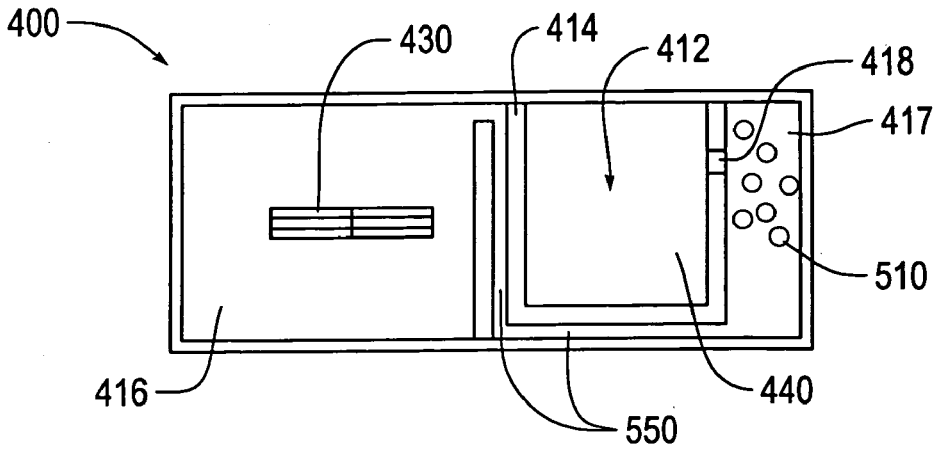
FIG. 11 is an enlarged schematic y-z cross-sectional view of a refillable fluid container an exemplary embodiment of this invention such as FIG. 6.

FIG. 11 shows an enlarged schematic y-z cross-sectional view of a further exemplary embodiment of refillable fluid container 400. The refillable fluid container 400 includes a manifold area 460, a liquid fluid reservoir 416, the at least one additional liquid fluid reservoirs 417, a capillary medium chamber 412 and an optical fluid sensing system 430. The liquid fluid reservoirs 416 and 417 are separated from capillary medium chamber 412 by a barrier wall 414. Communication between the at least one additional liquid fluid reservoir 417 and capillary medium chamber 412 is enabled by at least one barrier gap or orifice 418 in barrier wall 414. Free communication of fluid between the liquid fluid reservoir 416 and the at least one additional liquid fluid reservoir 417 is enabled by at least one narrow fluid communication channel 550. The liquid fluid reservoirs 416 and 417 include an air accumulation area 525. The liquid fluid reservoir 416 and manifold area 460 are separated by a filter means 466.

Figure 12:
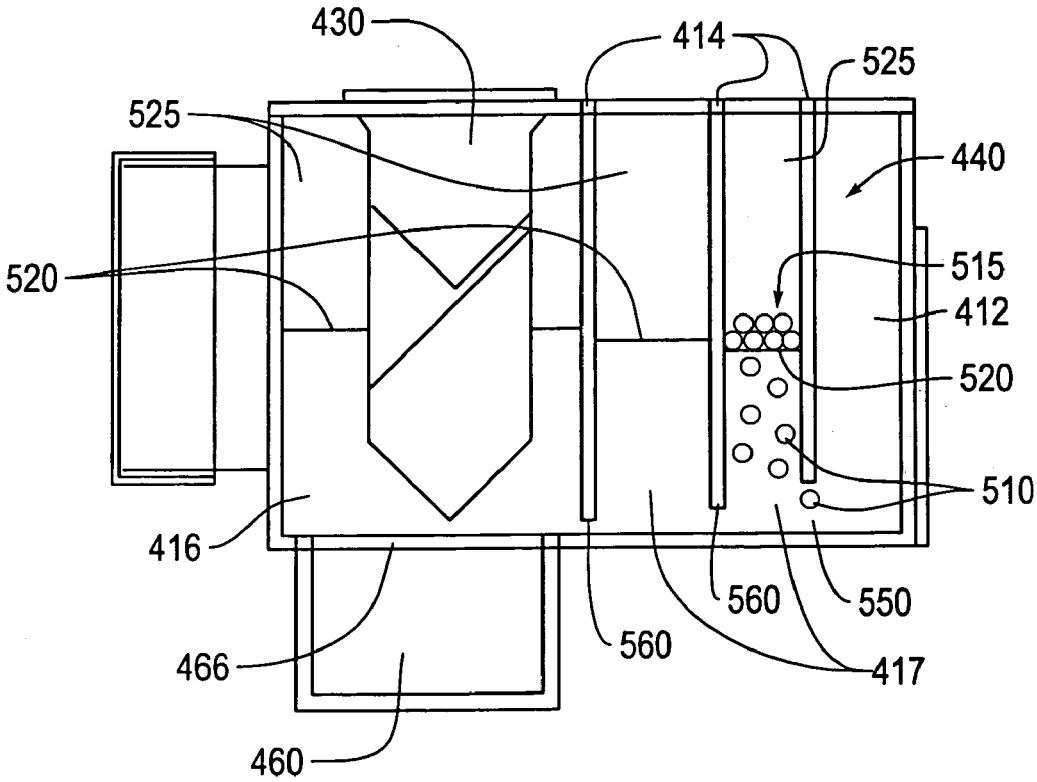
FIG. 12 is an enlarged schematic y-z cross-sectional view of an exemplary embodiment of a refillable fluid container according to this invention.

FIG. 12 shows an enlarged schematic y-z cross-sectional view of a further exemplary embodiment of refillable fluid container 400. The refillable fluid container 400 includes a manifold area 460, a liquid fluid reservoir 416, at least one additional liquid fluid reservoirs 417, a capillary medium chamber 412 and an optical fluid sensing system 430. The liquid fluid reservoirs 416 and 417 are separated from each other and from capillary medium chamber 412 by barrier walls 414. Free communication of fluid between the at least one additional liquid fluid reservoir 417 and capillary medium chamber 412 is enabled by at least one barrier gap or orifice 418 in each barrier wall 414 separating the at least one additional liquid fluid reservoir 417 and the capillary medium chamber 412. Free communication of fluid between the liquid fluid reservoir 416 and the at least one additional liquid fluid reservoir 417 is enabled by at least one additional barrier gap or orifice 560. The at least one additional barrier gap or orifice 560 may be narrower than barrier gap or orifice 550, and the top surface of the at least one additional barrier gap or orifice 560 may be lower than that of barrier gap or orifice 550. This structure allows the separated reservoirs to individually drain, allowing reservoir 416 to drain last. The liquid fluid reservoirs 416 and 417 include an air accumulation area 525. The liquid fluid reservoir 416 and manifold area 460 are separated by a filter means 466.

It should be noted that the geometries of the refillable fluid container 400, the manifold area 410, the liquid fluid reservoir 416, the at least one additional liquid fluid reservoir 417 and the capillary medium chamber 412 are not particularly limited. The liquid fluid reservoir 416 and at least one additional liquid fluid reservoir 417 may be combined into a single liquid fluid reservoir, provided the barrier gap or orifice 418 in barrier wall 414 is oriented away from the optical sensing device 430.

While this invention has been described in conjunction with the exemplary embodiments outlined above, various alternatives, modifications, variations, improvements, and/or substantial equivalents, whether known or that are, or may be, presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the systems, methods and devices according to this invention are intended to embrace all known or later-developed alternatives, modifications, variations, improvements, and/or substantial equivalents.

What is claimed is:

1. A fluid ejection container system for containing fluid, comprising:

a first chamber for holding a fluid, the first chamber having a first portion and a second portion that are separated from each other and at least one channel that allows fluid to be communicated between the first portion and the second portion;

a second chamber having a capillary medium for holding the fluid;

an orifice between the first portion of the first chamber and the second chamber that allows the fluid to communicate between the first portion of the first chamber and the second chamber at a level wherein the orifice is wetted with the fluid, the orifice being directed away from the second portion of the first chamber; and a fluid level sensing means located in the second portion of the first chamber.

2. The fluid ejection container system according to claim 1, wherein orifice forms a bubbler region in the first portion of the first chamber that creates air bubbles during fluid ejection.

3. The fluid ejection container system according to claim 2, wherein the bubbler region is separated from the fluid level sensing means.

4. The fluid ejection container system according to claim 3, wherein the bubbler region is in fluid contact with the second portion of the first chamber containing the fluid level sensing means by the at least one channel that allows fluid to flow therebetween. and the at least one channel is controlled to minimize air bubble travel into the second portion.

5. The fluid ejection container system according to claim 4, wherein at least two channels are provided.

6. The fluid ejection container system according to claim 3, further comprising a third chamber for holding the fluid and at least one channel between the first chamber and the third chamber allowing the fluid to flow therebetween.

7. An ink jet printhead cartridge containing the fluid ejection container system according to claim 1, wherein the fluid is ink.

8. A fluid ejection container system for containing fluid, comprising:

a first chamber for holding a fluid;

a second chamber having a capillary medium for holding the fluid;

a third chamber for holding the fluid;

a passage between the second and third chambers communicating the fluid at a level wherein the passage is wetted with the fluid;

at least one channel between the first and third chambers allowing the fluid to flow therebetween; and a fluid level sensing means located in the first chamber;

wherein the passage between the second and third chambers is directed away from the at least one channel that allows the fluid to flow therebetween.

9. The fluid ejection container system according to claim 8, wherein the first and third chambers are adjacent.

10. The fluid ejection container system according to claim 8, wherein the second chamber is located between the first and third chambers and the at least one channel is located along at least one wall of the second chamber.

11. The fluid ejection container system according to claim 8, wherein the passage between the second and third chambers forms a bubbler region that creates air bubbles during fluid ejection.

12. The fluid ejection container system according to claim 11, wherein the bubbler region is in fluid contact with the first chamber containing the fluid level sensing means by the at least one channel, and the at least one channel is controlled to minimize air bubble travel into the first chamber.

13. The fluid ejection container system according to claim 12, wherein at least two channels are provided.

14. An ink jet printhead cartridge containing the fluid ejection container system according to claim 8, wherein the fluid is ink.

15. A fluid ejection container system for containing fluid, comprising:

a first chamber for holding a fluid, the first chamber being evacuated to a negative gauge pressure when being filled with the fluid;

a second chamber having a capillary medium for holding the fluid;

a third chamber for holding the fluid, the third chamber being evacuated to a negative gauge pressure when being filled with the fluid;

a passage between the second and third chambers communicating the fluid at a level wherein the passage is wetted with the fluid;

at least one channel between the first and third chambers allowing the fluid to flow therebetween; and a fluid level sensing means located in the first chamber;

wherein the passage between the second and third chambers is directed away from the at least one channel that allows the fluid to flow therebetween.

16. The fluid ejection container system according to claim 15, wherein the passage between the second and third chambers forms a bubbler region that creates air bubbles during fluid ejection.

17. The fluid ejection container system according to claim 16, wherein the bubbler region is in fluid contact with the first chamber containing the fluid level sensing means by the at least one channel, and the at least one channel is controlled to minimize air bubble travel into the first chamber.

18. The fluid ejection container system according to claim 17, wherein at least two channels are provided.

19. An ink jet printhead cartridge containing the fluid ejection container system according to claim 15, wherein the fluid is ink.

* * * * *